United States Patent [19]

Carel et al.

[11] Patent Number: 4,870,903

[45] Date of Patent: Oct. 3, 1989

[54] PHOTOPYROTECHNICAL DETONATION DEVICE AND PHOTOPYROTECHNICAL CHAIN USING THIS DEVICE

[75] Inventors: Claude Carel, Saint Aubin de Medoc; Alain Josse, Saint Medard en Jalles, both of France

[73] Assignee: Aerospatiale Societe Nationale Industrielle, Paris Cedex, France

[21] Appl. No.: 194,854

[22] Filed: May 17, 1988

[30] Foreign Application Priority Data

May 20, 1987 [FR] France ..... 87 07069

[51] Int. Cl.[4] ..... F42C 19/00

[52] U.S. Cl. ..... 102/201

[58] Field of Search ..... 102/201; 244/3.12

[56] References Cited

U.S. PATENT DOCUMENTS

| | | | |
|---|---|---|---|
| 3,296,795 | 1/1967 | Nielsen | 102/201 |
| 3,362,329 | 1/1968 | Epstein | 102/201 |
| 3,528,372 | 9/1970 | Lewis et al. | 102/201 |
| 3,618,526 | 11/1971 | Baker | 102/201 |
| 3,685,392 | 8/1972 | Platt | 102/201 |
| 3,757,078 | 9/1973 | Conti et al. | 219/121 L |
| 3,812,783 | 5/1974 | Yang et al. | 102/201 |
| 3,911,822 | 10/1975 | Boling | 102/201 |
| 4,343,242 | 8/1982 | Welk | 102/201 |
| 4,391,195 | 7/1983 | Shann | 102/201 |
| 4,506,606 | 3/1985 | Caruso | 102/487 |
| 4,563,057 | 1/1986 | Ludman et al. | 350/96.18 |
| 4,660,472 | 4/1987 | Stevens | 102/202.1 |

FOREIGN PATENT DOCUMENTS

| | | |
|---|---|---|
| 0040011 | 11/1981 | European Pat. Off. . |
| 2031889 | 11/1970 | France . |
| 2263064 | 10/1975 | France . |
| 2001780 | 2/1979 | United Kingdom . |

OTHER PUBLICATIONS

"Large Sapphire Lens"; *Electronics;* Feb. 27, 1959; p. 83.

Yang, L. C., et al; "Detonation of Insensitive High Explosives by a Q-Switched Ruby Laser"; *Applied Physics Letters* vol. 19, No. 11, pp. 473–475; 12/1971.

Yang, L. C., et al; "Laser Initiation of Explosive Devices"; *National Defense;* pp. 344–347; 1974.

Nasa Tech Brief, "Laser System to Detonate Explosive Devices", Nov. 1974.

*Primary Examiner*—Charles T. Jordan

*Attorney, Agent, or Firm*—Pearne, Gordon, McCoy & Granger

[57] ABSTRACT

A photopyrotechnical detonating device and a photopyrotechnical chain using this device are disclosed. A pyrotechnical charge, which can be actuated by a laser beam, is placed in a solid body. The beam is conveyed by an optical fiber which penetrates a connector mounted on the body. The beam, which is divergent when it leaves the fiber, is made parallel by a first lens. A second lens, mounted on the body, makes the beam converge and works with a transparent barrier to focus the beam on a given point. Tight-sealilng means are provided between the transparent barrier and the body of the device, thus ensuring the containment of the charge. The transparent barrier is shaped like a truncated cone which maintains its integrity within a tapered cylinder after firing of the actuating and boosting charges. The tightness of the transparent barrier within the tapered cylinder is enhanced by the sealing means and prevents fragments from entering the detonating device after firing of the charges.

13 Claims, 4 Drawing Sheets

PHOTOPYROTECHNICAL DETONATION DEVICE AND PHOTOPYROTECHNICAL CHAIN USING THIS DEVICE

BACKGROUND OF THE INVENTION

1. Field of the Invention

The present invention pertains to the detonation of pyrotechnical substances by laser-produced light beams conveyed by optical fibers or cables.

It may be recalled that the term "pyrotechnical substances" is taken to mean primary explosives (such as nitrides, fulminates, tetrazene, etc.), secondary explosives (such as PETN, RDX, HNS, etc.) and pyrotechnical compositions such as flash compositions, compositions for light flares, tracers, smoke shells etc. The various elements used form what is called a functional photopyrotechnical chain. This chain generally consists of three elements:

a laser as a source of energy, an optical fiber or cable to convey the energy, a primer detonator or pyrotechnical firing device.

2. Description of the Prior Art

As a laser source, a triggered, pulsed laser is preferably used. A laser of this type is described by C. CAREL and A. P. JOSSE (of the Aerospatiale firm) and P. BALDY and J. REFOUVELET (Ateliers de Construction de Tarbes) in "Initiation d'Explosifs par Laser" (Actuating Explosives by Laser), Communication to the Internation Colloquium on Fundamental and Applied Pyrotechnics: Substances and Systems, 5–7 October, 1982, Arcachon, France.

A photopyrotechnical primer detonator is a device loaded with primary or secondary explosives which may be actuated under the effect of an energy beam such as a laser beam and which procures a shock wave sufficient to actuate another pyrotechnical component charged with explosives. Pyrotechnical firing devices are devices containing a pyrotechnical substance capable of catching fire when it receives a supply of heat, for example in the form of a laser beam, the resultant flame being capable of firing another pyrotechnical composition.

The document U.S.A. 4,391,195 describes a system for actuating explosives with a laser source and optical fibers to convey the energy from the laser to pyrotechnical detonating devices. According to this document, the end of the optical fiber opposite the laser is in direct contact with a substance capable of catching fire, and the energy from the resultant flame is used to detonate explosive charges. However, most of the present-day photopyrotechnical detonating devices have a poor level of imperviousness to the exterior. This fact entails two disadvantages. First of all the pyrotechnical detonating substance is badly protected from external influences (such as damp or atmospheres with varying degrees of corrosiveness), and this can adversely affect its operation. Secondly, when the charge is being fired, there is a risk of efficiency losses due to leakages of gas released during detonation as well as a risk of surrounding equipment being polluted.

An aim of the present invention is to remove these drawbacks by proposing a photopyrotechnical detonating device in which the pyrotechnical detonating substance is protected from adverse external conditions before and during operation, and for which the actuating energy source cannot be damaged by any backthrust of gas under pressure (≦400 Kbars) during and after the explosion.

SUMMARY OF THE INVENTION

More precisely, an object of the invention is a photopyrotechnical device comprising a body which has, in a known way:

a cavity to house a pyrotechnical charge, an input for an energy beam of a given wavelength, used to actuate this charge, and a passage for the energy beam between said input and the cavity.

According to the invention, the device further comprises:

a transparent barrier placed in the passage, in the path of the beam, said barrier withstanding the effects of mechanical forces created during the operation of the charge and being made of a material which is transparent to the wavelength of this beam, and tight-sealing means between this barrier and the body of the device.

Preferably, the transparent barrier is made of sapphire.

Thus, the presence of a transparent barrier, made of a material transparent to the wavelength of the beam used, and the presence of tight-sealing means between this barrier and the body of the device protects the pyrotechnical charge from external adverse effects while, at the same time, letting through the beam used to detonate this charge. Furthermore, since the constitution of this barrier enables it to withstand the effects of mechanical forces created during the operation of the charge, said barrier remains intact after the charge is fired, and possible leakages of gas through the passage, made for the laser beam, are prevented.

If necessary, the device may further have a thin percussion cap placed between the transparent barrier and the pyrotechnical charge, said percussion cap having one surface in contact with the pyrotechnical charge.

The presence of this percussion cap is useful above all when the pyrotechnical charge is a substance that can explode under the effect of a shock wave. It is used when the device has means to focus the laser beam. As shall be seen further below, these focusing means are arranged so as to focus the beam on this percussion cap or to obtain, on the percussion cap, a beam which is the image of the beam on the output side of the optical fiber: thus a concentration of energy, capable of creating a shock wave, is created in the mass of the percussion cap. This shock wave is transmitted to the pyrotechnical substance which then explodes.

According to another aspect of the invention, when the body of the photopyrotechnical device is mounted on a support, tight-sealing means are further provided between the body of the device and this support.

This support may be an apparatus containing the main explosive charge which has to be detonated by the photopyrotechnical device. Thus, the main charge is itself protected from external adverse effects.

According to another aspect of the invention, the transparent barrier having a first surface on the input side and a second surface on the pyrotechnical charge side, its positioning and the shape of its two surfaces are defined so as to focus, on a given point, a parallel energy beam having said given wavelength and penetrating this transparent barrier through its first surface.

This arrangement is especially advantageous when, as shall be seen below, an optical connection system is used between the optical fiber conveying the laser beam and the photopyrotechnical actuating device, this connection system having a lens that converts the beam leaving the fiber into a parallel beam.

The device according to the invention can be fitted with means for focusing the laser beam. Preferably, these focusing means comprise:

a first lens cut so as to convert the energy beam that reaches the device into a parallel beam;

a second lens placed between the first lens and the transparent barrier so that the energy beam successively goes through the first lens, the second lens and the transparent barrier, the position and shape of the second lens and of the transparent barrier being defined so that the parallel energy beam leaving the first lens is focused on a given point.

This arrangement has the advantage of making it easier to adjust the position of the optical system for focusing the laser beam. For, since this beam is parallel in its path between the two lenses, it can be focused by the assembly comprising the second lens and the transparent barrier, regardless of the distance between the two lenses. The mounting of the lenses is thus made easier since a positioning error, causing a variation in the distance between the two lenses, does not modify the position of the point of focus of the beam.

The first lens can be mounted on an independent optical connector and the second lens can be mounted on the body of the device. If necessary, both lenses can be mounted on an independent connector or can be mounted permanently on the body of the device. Again, the second lens may be eliminated and one or both surfaces of the transparent barrier may be cut so as to focus the parallel beam leaving the first lens on a given point. In this case, it is the transparent barrier or its first surface that acts as a second lens. Whatever the arrangement, the fact that the beam is made parallel along a part of its path makes it easier to mount the optical system and to adjust its position since the distance between the two lenses may be of any value.

Finally, yet another object of the invention is a functional photopyrotechnical chain comprising, in a known way:

a laser source that emits a beam of a given wavelength;

a photopyrotechnical detonating device, and an optical cable conveying the beam from the laser source to the detonating device.

According to the invention, the detonating device complies with the above description and the laser source preferably consists of a triggered, pulsed laser. The term "optical cable" designates an optical fiber by itself or a set of optical fibers.

BRIEF DESCRIPTION OF THE DRAWINGS

The invention will be better understood from the following description, given purely as an example which in no way restricts the scope of the invention. The description is made with reference to the following drawings, of which.

DESCRIPTION OF PREFERRED EMBODIMENTS

Figure 1:
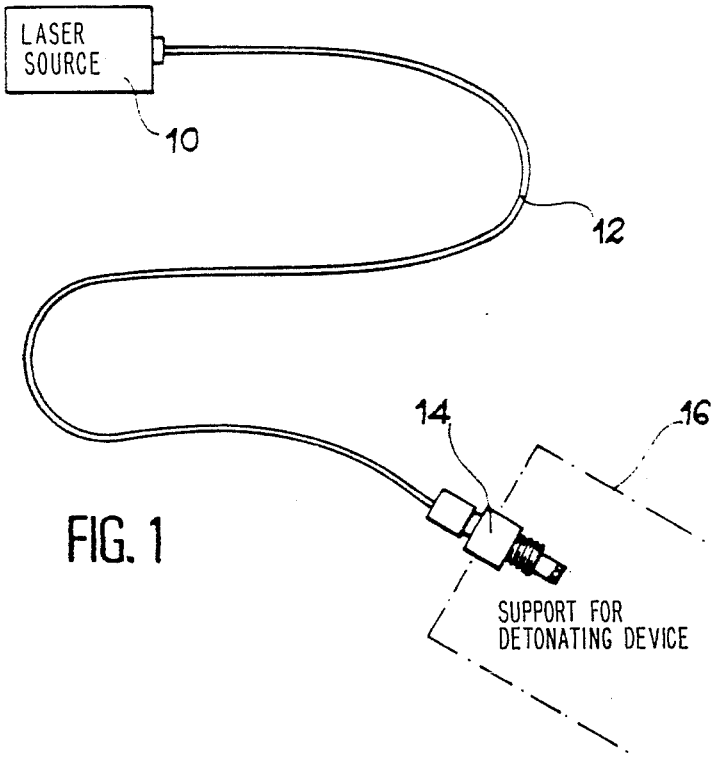
FIG. 1 is a schematic diagram showing the general appearance of a photopyrotechnical detonating system.

FIG. 1 gives a schematic view of a functional photopyrotechnical chain comprising a laser source 10 and an optical fiber 12 transmitting the laser-produced beam to a photopyrotechnical detonating device 14. This photopyrotechnical detonating device 14 is placed on a support, shown schematically with dots and dashes in FIG. 1. This support may be, for example the wall of a container or of a device containing the main charge which has to be actuated by device 14.

Figure 2:
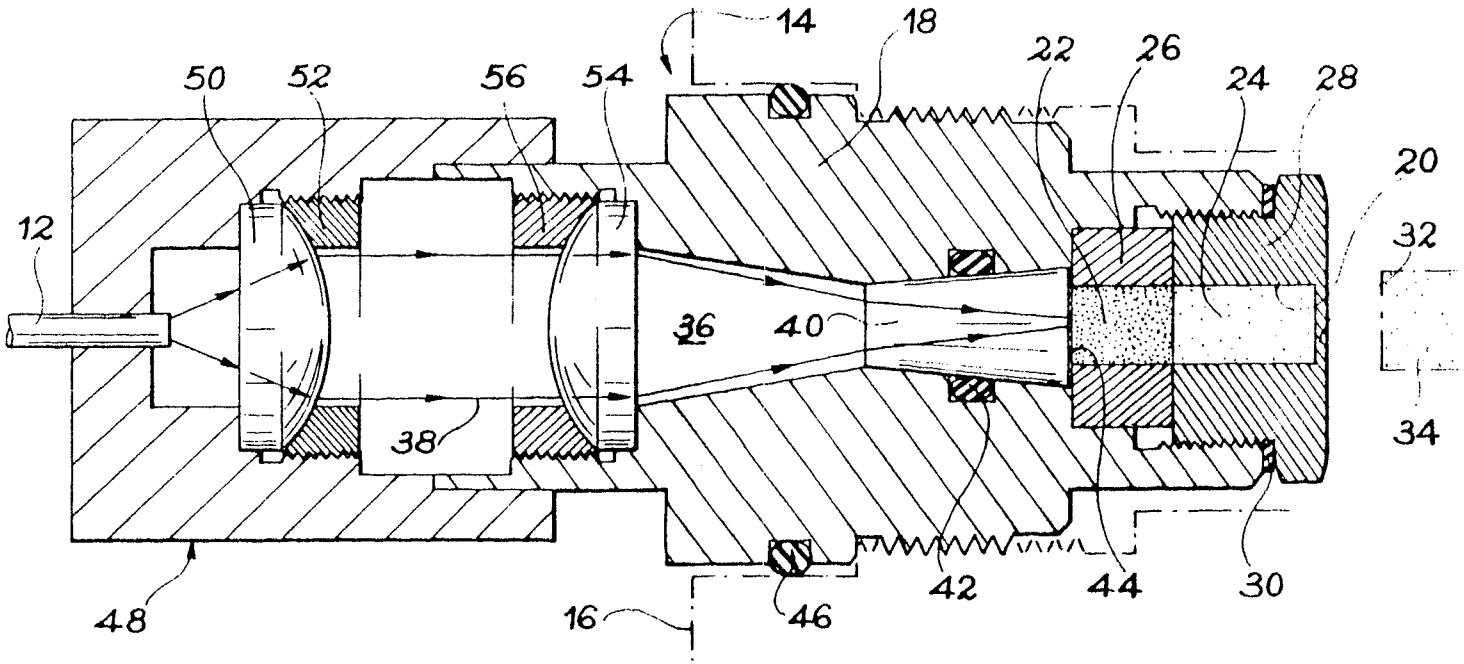
FIG. 2 is a schematic sectional view of an embodiment of the photopyrotechnical detonating device according to the invention.

Device 14 appears more clearly in the sectional view of FIG. 2 where it is seen that it consists, firstly, of a body 18 fixed to support 16 by any appropriate means, for example by being screwed in. Shell 18 has, at one of its ends, a cavity 20 to house a pyrotechnical charge. In the example shown herein, this charge consists of an actuating charge 22, in contact with a boosting charge 24. Cavity 20 can be made inside a charge-holder consisting of a spacer 26 held against a shoulder provided inside the body 18 by means of a cap 28. This cap 28 is fixed to body 18 by any known means, for example by being screwed in as shown in FIG. 2, with imperviousness being provided by a seal 30. However, other fixing methods such as laser soldering may be considered.

Cap 28 has a thinned part or percussion cap 32 which is destroyed in the explosion of charge 24. When charge 22 is fired under the effect of the laser beam emitted by source 10, it is the center of a shock wave. This wave spreads through charge 22, and then through charge 24 where it is boosted. The explosion of charge 24 causes the destruction of percussion cap 32, and the shock wave can thus fire the main charge 34 contained within support 16 (shown schematically with dots and dashes in FIG. 2).

Shell 18 of the device according to the invention also has a passage 36 enabling beam 38 to penetrate into the device. A transparent barrier 40 is mounted inside passage 36, upstream of cavity 20 as seen in the direction in which the beam moves. It must be noted that, in the example shown herein, all the elements of the device are rotationally symmetrical around a common axis. Transparent barrier 40 is shaped like a truncated cone that widens out towards cavity 20 and is bounded, at both ends, by plane, circular surfaces perpendicular to the axis of symmetry of the device. This transparent barrier is housed in a part of passage 36 of the same shape, the imperviousness between barrier 40 and body 18 being ensured by tight-sealing means 42, for example a rubber O-ring seal. The imperviousness between body 18 and support 16 is provided by an O-ring seal 46 or by any other equivalent device. This special embodiment provides total imperviousness against backthrusts of gas under pressure (≦400 Kbars) during the explosion.

Tests have shown that the best results are obtained with a sapphire transparent barrier shaped like a truncated cone, 10 mm long, bounded by two circular surfaces with diameters of 4 mm and 6 mm respectively, and with a length of 10 mm. Good results have also been obtained with an 8 mm long sapphire truncated cone with end surfaces having diameters of 4 mm and 6 mm respectively.

The sapphire, which is a special aluminium oxide ($AL_2O_3$), is well suited to this use because it has a very high Young's modulus ($3.7.10^5$ MPa). Furthermore, its softening point is at 1800° C., and this gives it high resistance to temperature (as a comparison, it may be noted that B1664 glass has a transformation temperature of 559° C.).

FIG. 2 again shows a thin percussion cap 44 interposed between transparent barrier 40 and actuating charge 22. In the example shown here, this percussion cap has the form of a thin coating deposited on the rear surface of the barrier 40. The thickness of this coating ranges between a few hundred Angstroms and a few thousand Angstroms, and its constituent material may be a metal such as, for example, aluminium, gold, silver, niobium or indium. However, the use of any other material (for example, an organic material) or any other arrangement (for example, an arrangement with the coating deposited on actuating charge 22) would not be beyond the scope of the invention. The usefulness of this percussion cap comes into play when a secondary explosive is used as the actuating charge. For, a powerful shock wave is needed to actuate an explosive of this type. This shock wave can be obtained by the breakdown of a thin metallic layer, and the breakdown of the percussion cap 44 can be got by focusing beam 38 on this percussion cap 44.

The device shown in FIG. 2 further has means for focusing the laser beam. These means consist essentially of an optical connector in the shape of a hollow case which can be fitted over that end of body 18 which is opposite cavity 20. Optical fiber 12 transmits the beam from the laser to device 14 through a wall of connector 48, and its end is inside this connector. The laser beam leaving the fiber 12 goes through a first lens 50, mounted inside connector 48. This lens can be held on a shoulder or support by means of a brace 52, screwed inside connector 48. The shape of lens 50 is defined so that the beam 38, which is divergent when it leaves fiber 12, is parallel after it has gone through lens 50, its optical axis being identical with the axis of revolution of device 14. A second lens 54 is mounted inside body 18, in the passage 36, and it is between the first lens and the transparent barrier 40. Like lens 50, lens 54 can be held in a housing or support by means of a brace 56.

Thus, when connector 48 is mounted on body 18, beam 38 is parallel upon leaving first lens 50, and is still parallel when it reaches second lens 54. This second lens 54 is a convergent lens, thus making beam 38 convergent along its path between lens 54 and transparent barrier 40. When beam 38 touches transparent barrier 40, it is still refracted but remains convergent, and strikes the percussion cap 44. The shape and location of lens 54 and barrier 40 are defined so that the parallel beam entering lens 54 is focused in such a way that the beam obtained on percussion cap 44 is the image of the beam at the fiber output. The concentration of the beam at this point causes the optical breakdown of percussion cap 44. This leads to the creation of a shock wave inside actuating charge 22, thus making the device work.

Figure 3:
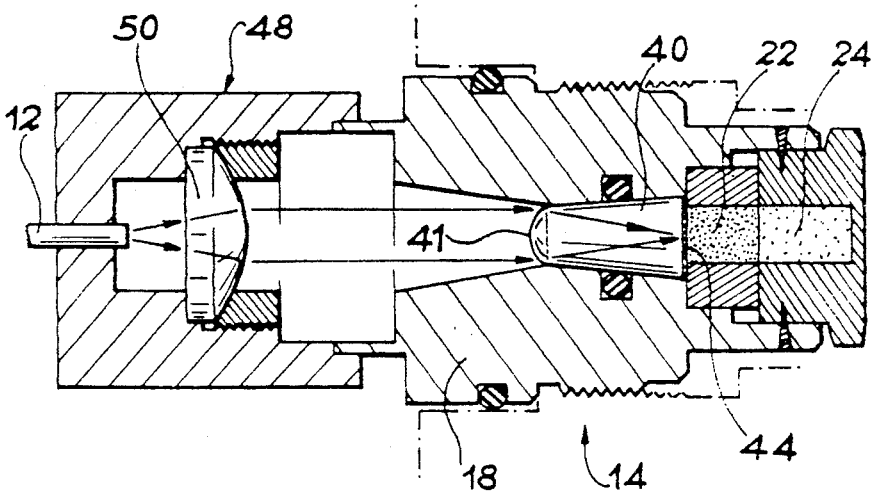
FIG. 3 is a view, similar to the one shown in FIG. 2, which shows, on a smaller scale, another embodiment of the device according to the invention.

FIG. 3 shows a device similar to that of FIG. 2, but one in which lens 54 is eliminated while the front side 41 of barrier 40 is convex shaped when seen from the input side of the device. Thus, the front side of the barrier 40 behaves like a plano-convex lens that causes the parallel beam coming from first lens 50 to converge. In this case, the shape of side 41 and the length of barrier 40 are defined according to the wavelength of the beam, so that beam is focused on a given point, for example, to obtain a beam on percussion cap 44 which is the image of the beam on the output side of fiber 12. It is therefore the front side 41 of barrier 40 that constitutes the second lens of the device.

Thus, the device according to the invention has particularly worthwhile advantages, the main one of which is the efficient containment of the pyrotechnical charge before operation, and of the products of detonation after operation. This is achieved by the presence of the transparent barrier 40, which is fixed imperviously within body 18, and is made of a material that withstands the effects of the detonation. Furthermore, the mounting, setting and positioning operations are made easier by the use of an optical system which makes laser beam 38 parallel along a portion of its path. The distance between the two lenses no longer needs to be defined with precision since, even if this distance varies, the beam remains parallel when it reaches the second lens. However, the centering of the various elements must be seen to: this is relatively easy inasmuch as the constituent elements of the device have rotational symmetry.

Finally, it is understood that the invention is not restricted solely to the embodiment that has just been described, and that it is possible to envisage a great many alternatives without in any way going beyond the scope of the invention. Thus, for example, the percussion cap 44 may or may not be used, or the actuating charge 22 may be replaced by a substance which catches fire under the effect of the energy supplied by the laser beam, the resulting flame causing the explosion of another pyrotechnical substance. It is also possible to replace the two charges 22 and 24 by a single charge.

It is also possible to modify the shape of the barrier 40 and the device of the invention may or may not be associated with an optical system, as shown in FIGS. 4 to 7.

Figure 4:
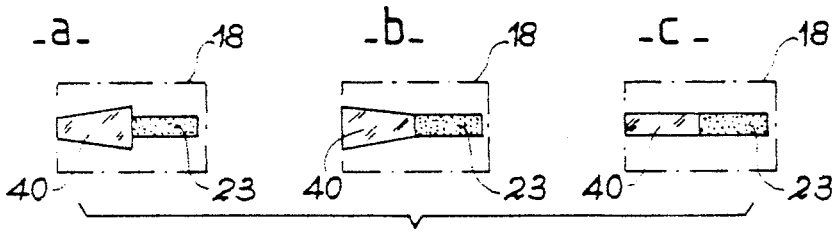
FIGS. 4*a* to 4*c* and 5*a* to 5*c* are schematic views showing various possible embodiments of the device according to the invention when there is no associated optical system.
Figure 5:
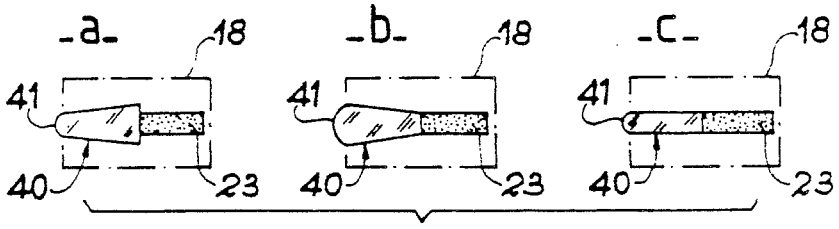

In the example of FIGS. 4 and 5, there is no associated optical system. In the FIGS. 4*a* to 4*c*, the input and output sides of the transparent barrier 40 are plane, and are perpendicular to the axis of symmetry of the device. In the example of FIG. 4*a*, barrier 40 is shaped like a truncated cone that widens towards charge 23, as in while, in the example of FIG. 4*b*, it narrows towards charge 23. In the example of FIG. 4*c*, barrier 40 has the shape of a cylindrical rod with a constant diameter.

FIGS. 5*a* to 5*c* illustrate a case where the front side 41 of barrier 40 is convex shaped and cut so as to focus a parallel beam reaching this side 41 on a given point of the device. In FIG. 5*a*, barrier 40 is shaped like a truncated cone widening towards charge 23 while, in the example of FIG. 5*b*, it narrows towards this charge. Finally, in the example of FIG. 5*c*, barrier 40 is cylinder shaped as in FIG. 4*c*.

Figure 6:
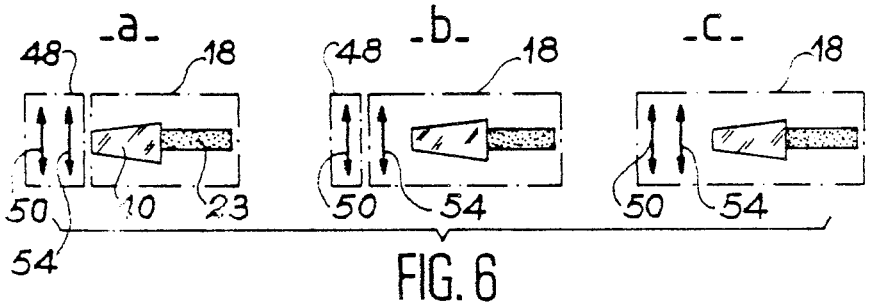
FIGS. 6*a* to 6*c* and 7*a* and 7*b* are schematic views showing various possible embodiments of the device according to the invention with an associated optical system.
Figure 7:
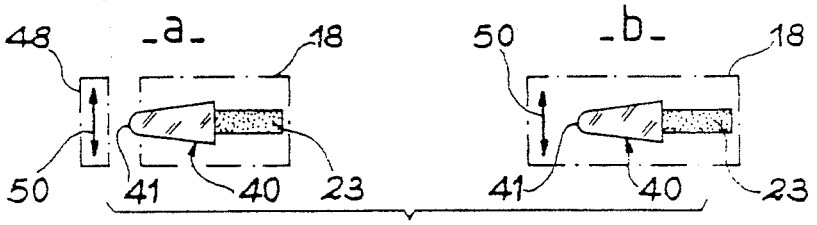

FIGS. 6 and 7 shows alternative embodiments in which the device of the invention is associated with an optical system.

FIGS. 6*a* to 6*c* pertain to embodiments in which the input and output sides of barrier 40 are plane, and are perpendicular to the axis of symmetry of the device, barrier 40 having the shape of a truncated cone that widens out towards charge 23. In the example of FIG. 6*a*, the two lenses 50 and 54 are mounted in a connector 48 which is independent of body 18 of the device. FIG. 6*b* corresponds to what is shown in FIG. 2, first lens 50 being mounted on connector 48 and second lens 54 being mounted on body 18. Finally, in the example of FIG. 6*c*, both lenses are mounted on body 18, and there is no detachable connector.

FIGS. 7*a* and 7*b* relate to an example where the front side of the barrier 40 is convex shaped in order to constitute the second lens. In FIG. 7*a*, first lens 50 is mounted on an independent connector 48 while, in the example of FIG. 7*b*, first lens 50 is mounted permanently in body 18. Finally, it must be noted that, in FIGS. 6 and 7, transparent barrier 40 always has the shape of a truncated cone widening towards pyrotechnical charge 23. However, this transparent barrier could be given other shapes, for example the shape of a truncated cone narrowing towards charge 23 or the shape of a cylindrical rod as shown in FIGS. 4 and 5, without going beyond the scope of the invention.

Figure 8:
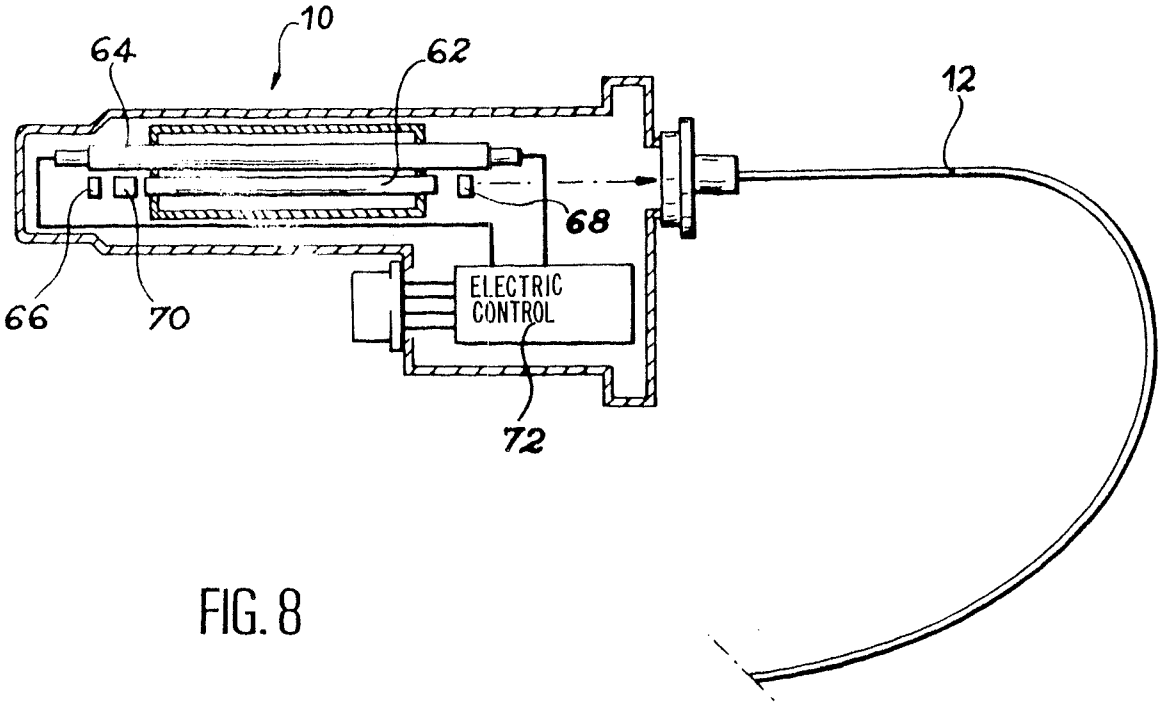
FIG. 8 is a schematic sectional view of a laser which can be used in a functional photopyrotechnical chain according to the invention.

FIG. 8 shows a preferred embodiment of a laser that can be used in the invention.

The laser 10 comprises an amplifier rod 62, a straight flash tube 64, two mirrors 66 and 68, a trigger 70 (with a coloring agent or a Pocket cell) and an electronic unit 72.

The rod 62 is made of a neodymium-doped glass working at a wavelength of 1.06 μm corresponding, to an optical window of optical fiber 12. Operation in the triggered mode is obtained by interposing a saturable absorbent product 70 (active type triggering) or a Pocket cell (passive type triggering) between the two mirrors of the optical cavity. The laser pulse, which has an approximately Gaussian shape, has a pulse duration of about 10 ns at mid-height.

The optical energy is about 75 mJ with a saturable absorbent product and about 150 mJ with a Pockel cell.

What is claimed is:

1. A photopyrotechnical detonating device comprising a body with:

a cavity to house a pyrotechnical charge, an input for an energy beam of a given wavelength, used to actuate this charge, and a passage for the energy beam between said input and the cavity, said photopyrotechnical device further comprising:

a transparent barrier placed in the passage, in the path of the beam, said barrier withstanding the effects of mechanical forces generated during the operation of the charge and being made of a material which is transparent to the wavelength of this beam, and having a first surface on the input side and a second surface on the pyrotechnical charge side, its position and the shape of its two surfaces being defined so as to focus, on a given point, a parallel energy beam, having said given wavelength and penetrating this transparent barrier through its first surface, and tight-sealing means between this barrier and the body of the device, wherein the transparent barrier has the shape of a truncated cone that widens out towards the cavity, and wherein the tight-sealing means constitute an O-ring seal.

2. A device according to claim 1 wherein the transparent barrier is made of sapphire.

3. A device according to claim 1 comprising a thin percussion cap, placed between the transparent barrier and the pyrotechnical charge and having one side in contact with the pyrotechnical charge.

4. A device according to claim I wherein, the body being mounted on a support, said device comprises tight-sealing means between the body and this support.

5. A device according to claim 1 wherein, the transparent barrier having a first surface on the input side and a second surface on the pyrotechnical charge side, its positioning and the shape of its two surfaces are defined so as to focus, on a given point a parallel energy beam having said given wavelength and penetrating this transparent barrier through its first surface.

6. A device according to claim 1 further comprising means to focus the energy beam on a given point.

7. A device according to claim 6 wherein the focusing means comprise:

a first lens cut so as to convert the energy beam, reaching the device, into a parallel beam;

a second lens placed between the first lens and the transparent barrier so that the energy beam successively goes through the first lens, the second lens and the transparent barrier, the position and shape of the second lens and of the transparent barrier being defined so that the parallel energy beam leaving the first lens is focused on a given point.

8. A device according to claim 7 wherein the first lens is mounted on an optical connector which can be fixed, in a detachable way, on the body of the device.

9. A device according to claim 7, wherein the two lenses are mounted on an optical connector which can be fixed, in a detachable way, on the body of the device, the second lens being in a position that enables the focusing of the energy beam on a given point when the optical connector is mounted on the body of the device.

10. A device according to claim 7 wherein the two lenses are fixed inside the body of the device.

11. A photopyrotechnical detonating device comprising a body with:

a cavity to house a pyrotechnical charge, an input for an energy beam of a given wavelength, used to actuate this charge, and a passage for the energy beam between said input and the cavity, said photopyrotechnical device further comprising:

a transparent barrier placed in the passage, in the path of the beam, said barrier withstanding the effects of mechanical forces generated during the operation of the charge and being made of a material which is transparent to the wavelength of this beam, and having a first surface on the input side and a second surface on the pyrotechnical charge side, its position and the shape of its two surfaces being defined so as to focus, on a given point, a parallel energy beam, having said given wavelength and penetrating this transparent barrier through its first surface, tight-sealing means between this barrier and the body of the device, means to focus the energy beam on a given point, wherein the focusing means comprises:

a first lens cut so as to convert the energy beam, reaching the device, into a parallel beam;

a second lens placed between the first lens and the transparent barrier so that the energy beam successively goes through the first lens, the second lens and the transparent barrier, the position and shape of the second lens and of the transparent barrier being defined so that the parallel energy beam leaving the first lens is focused on a given point, wherein the transparent barrier has a first surface on the input side and a second surface on the pyrotechnical charge side, its two surfaces being cut so as to focus the parallel beam leaving the first lens on a given point, the first surface of the transparent barrier thus constituting the second lens.

12. A photopyrotechnical chain comprising:

a laser source emitting a beam of a given wavelength;

a photopyrotechnical detonating device, and an optical cable conveying the beam from the laser source to the detonating device, wherein the detonating device comprises:

a body with:

a cavity to house a pyrotechnical charge, an input for an energy beam of an given wavelength, used to actuate this charge, and a passage for the energy beam between said input and the cavity, said photopyrotechnical device further comprising:

a transparent barrier placed in the passage, in the path of the beam, said barrier withstanding the effects of mechanical forces generated during the operation of the charge and being made of a material which is transparent to the wavelength of this beam, and having a first surface on the input side and a second surface on the pyrotechnical charge side, its position and the shape of its two surfaces being defined so as to focus, on a given point, a parallel energy beam, having said given wavelength and penetrating this transparent barrier through its first surface, tight-sealing means between this barrier and the body of the device, wherein the transparent barrier has the shape of as truncated cone that widens out toward the cavity, and wherein the tight-sealing means constitute an O-ring seal.

13. A chain according to claim 12 wherein the laser source is a triggered, pulsed laser.

* * * * *